US011248386B2

(12) United States Patent
Lopez et al.

(10) Patent No.: US 11,248,386 B2
(45) Date of Patent: Feb. 15, 2022

(54) POOL CLEANING SYSTEMS

(71) Applicants: Chris Lopez, Miramar, FL (US); Alvis Afanador, Miami, FL (US)

(72) Inventors: Chris Lopez, Miramar, FL (US); Alvis Afanador, Miami, FL (US)

( * ) Notice: Subject to any disclaimer, the term of this patent is extended or adjusted under 35 U.S.C. 154(b) by 145 days.

(21) Appl. No.: 16/456,331

(22) Filed: Jun. 28, 2019

(65) Prior Publication Data

US 2020/0018085 A1 Jan. 16, 2020

Related U.S. Application Data

(60) Provisional application No. 62/696,049, filed on Jul. 10, 2018.

(51) Int. Cl.

| | |
|---|---|
| ***E04H 4/16*** | (2006.01) |
| ***A46B 17/02*** | (2006.01) |
| ***A46B 5/00*** | (2006.01) |
| ***B25G 3/00*** | (2006.01) |
| ***B25G 3/02*** | (2006.01) |
| ***B25G 3/12*** | (2006.01) |

(52) U.S. Cl.

CPC ..... *E04H 4/1609* (2013.01); *A46B 5/002* (2013.01); *A46B 5/0095* (2013.01); *A46B 17/02* (2013.01); *B25G 3/00* (2013.01); *B25G 3/02* (2013.01); *B25G 3/12* (2013.01); *E04H 4/1618* (2013.01); *A46B 5/0075* (2013.01)

(58) Field of Classification Search

CPC ... E04H 4/1609; E04H 4/1618; E04H 4/1627; E04H 4/1636; E04H 4/1645; A46B 5/002; A46B 5/0095; A46B 17/02; B25G 3/00; B25G 3/02; B25G 3/12

USPC ..... 15/1.7, 143.1, 144.3, 144.4, 145, 146, 15/148; 210/167.1, 167.15–167.17; 16/110, 422, 426, 440, DIG. 23, DIG. 24, 16/DIG. 41

See application file for complete search history.

(56) References Cited

U.S. PATENT DOCUMENTS

| | | | | |
|---|---|---|---|---|
| 1,505,318 A * | 8/1924 | Berlow | B25G 3/16 403/205 |
| 2,624,061 A * | 1/1953 | Leas | A47L 9/02 15/144.4 |
| 4,114,321 A | 9/1978 | Jarvis et al. | |
| 4,247,216 A | 1/1981 | Panini | |
| 5,105,752 A * | 4/1992 | Pompei | B63B 59/08 114/222 |

(Continued)

FOREIGN PATENT DOCUMENTS

| | | |
|---|---|---|
| CN | 2169498 | * 7/1986 |
| FR | 2799669 | * 4/2001 |

*Primary Examiner* — Mark Spisich

(57) ABSTRACT

A pool cleaning system is provided. The system includes a pool pole. The system also includes an angled attachment device configured to connect to an end of the pool pole. The system additionally includes specialty tools structured to connect to an end of the angled attachment device. The angled attachment device is structured to connect to pool poles and to specialty devices in such a way to provide a plurality of angles to allow cleaning of pool surfaces and pool surface areas in an effective, efficient, and ergonomically friendly fashion for pool cleaning personnel. The pool cleaning system is arranged to change the angles at which the surfaces are being cleaned without having to change out components.

5 Claims, 7 Drawing Sheets

(56) References Cited

U.S. PATENT DOCUMENTS

| | | | | |
|---|---|---|---|---|
| 5,110,230 | A | 5/1992 | Cole, Jr. et al. | |
| 5,464,481 | A * | 11/1995 | Lietz, Jr | A46B 9/02 134/6 |
| 5,791,006 | A * | 8/1998 | Anctil | A46B 17/02 15/143.1 |
| 6,797,157 | B2 * | 9/2004 | Erlich | E04H 4/1636 210/94 |
| 6,951,311 | B1 | 10/2005 | Moran | |
| 8,024,833 | B2 * | 9/2011 | Fuller | A46B 9/02 15/1.7 |
| 8,771,435 | B2 | 7/2014 | Graffius | |
| 8,919,672 | B2 | 12/2014 | Chen | |
| 2004/0055099 | A1 * | 3/2004 | Greenberg | B25G 1/102 15/143.1 |
| 2004/0177460 | A1 * | 9/2004 | Wagner | A47L 13/12 15/114 |
| 2004/0261204 | A1 * | 12/2004 | Pears | A47L 11/38 15/28 |
| 2006/0002759 | A1 | 1/2006 | Blackman et al. | |
| 2013/0266364 | A1 | 10/2013 | John | |
| 2013/0269131 | A1 * | 10/2013 | Mallett | B25G 1/102 15/144.1 |
| 2013/0291327 | A1 * | 11/2013 | Perez | A46B 9/00 15/171 |
| 2014/0123422 | A1 | 5/2014 | Boyd | |

* cited by examiner

POOL CLEANING SYSTEMS

CROSS-REFERENCE TO RELATED APPLICATIONS

This application claims priority to provisional application 62/696,049 filed on Jul. 10, 2018, and is incorporated herein by reference in its entirety.

FIELD OF THE INVENTION

The present invention relates generally to cleaning systems, and more particularly, to pool cleaning systems, which utilize handles, attachment adaptors, angled attachment devices and specialty tools to improve pool cleaning evolutions, enhance efficiency and comfort during cleaning operations, and reduce potential injury to pool cleaning personnel.

BACKGROUND OF THE INVENTION

Many methods and systems have been used unsuccessfully attempting to provide pool cleaning staff with the adequate tools, systems, and methods to effectively clean pools without exposing personnel to potential chronic injuries. Several devices and methods have unsuccessfully been created to rectify the problem of effectively cleaning pool surfaces and of pool maintenance personnel suffering from chronic pain. These devices, systems and methods have not been reliable or effective.

The development of large complexes, such as condominiums, recreational parks, water parks, private residential communities, and assisted living communities have resulted in larger, intricately designed pools for large communities. Further, as the expanding variations of offerings of private pools with intricate designs, including water falls, walk-in portions, fashion trending steps, perimeter shapes including curvatures of different radii, the inclusion of water slides, and wave making devices have resulted in pools having unique shapes, curves, steps of various angles, and surfaces which are positioned at various angles and degrees from horizontal. These pool surfaces provide a challenge in keeping them clean. Past methods, apparatus, and systems have been unsuccessful, time consuming, costly, and ineffective.

Throughout most of the pool industry, pool cleaning and maintenance requires personnel to engage with systems, apparatus, and methods to manually clean pools and pool area surfaces. Because of the manual nature of cleaning evolutions and due to the different pool surfaces and pool area surfaces, effective cleaning of these surfaces is not achieved with the pool cleaning equipment previously available. These prior pool cleaning and maintenance efforts result in more cleaning evolutions, ineffective cleaning, more expense, and diminished customer satisfaction.

Due to the manual nature of cleaning pools and pool surfaces and the complexity of pool surfaces and pool surface areas, personnel expose themselves to repeated physical movement when carrying out their maintenance activities which over time may cause chronic pain and musculoskeletal damage. In the pool industry, most pool maintenance and pool cleaning personnel find themselves incapable of continuing within their profession due to chronic pain and discomfort, just after several years of work. Much of this pain and discomfort is due to the fact that current pool cleaning and maintenance methods, apparatus, and systems expose the pool cleaning personnel to awkward physical positions and unnatural physical movements when attempting to clean and maintain pool surfaces and pool area surfaces that have unique angles, unique structures, non-perpendicular intersections, and surfaces composed of different materials. These conditions are taxing on personnel, result in increased medical expenses, and bog down our Medicaid and Medicare systems because of chronic injuries to pool cleaning professionals.

Cleaning underwater pool surfaces requires a pool cleaning professional to manually maneuver a pool cleaning device onto the pool surfaces and apply pressure with a brush, with a pumice stone, or chemically clean the surface with an attachment. These cleaning evolutions often require personnel to bend their back in an awkward position in order to properly brush the pool walls and to contact the appropriate surfaces. Because many of the surfaces are curved, angled away in many different angles from horizontal, and include steps, waterfalls, water slides, or wave machines, cleaning of these surfaces requires even more difficult physical movement and positioning that is not ergonomically friendly for personnel cleaning the pool. Over a period of time these physical movements and positions could cause physical problems for pool cleaning personnel.

Accordingly, there is an established need for a cleaning system which solves at least one of the aforementioned problems. Further, there is an established need for a pool cleaning system which provides an ergonomically friendly system, apparatus, and/or method to clean pool surfaces and pool area surfaces in an efficient, effective, and time sensitive fashion, reduce operating costs, is reusable, reduces waste, provides all personnel with the tools, devices, apparatus, and systems to clean pool surfaces and pool surface areas in accordance with specific standards.

SUMMARY OF THE INVENTION

According to an aspect of the present invention, a pool cleaning system is provided. The system includes a pool pole. The system also includes an angled attachment device configured to connect to an end of the pool pole. The system additionally includes specialty tools structured to connect to an end of the angled attachment device.

According to another aspect, of the present invention, a pool cleaning apparatus is provided. The apparatus includes a pool pole. The apparatus also includes an angled attachment device configured to connect to an end of the pool pole. The apparatus additionally includes specialty tools structured to connect to an end of the angled attachment device.

According to yet another aspect, a method for cleaning pools is provided. The method includes attaching an angled attachment device to an end of a pool handle. The method also includes attaching a specialty tool to an end of the angled attachment device. Further, the method includes cleaning a pool surface and/or a pool surface area with the specialty tool connected to an end of the angled attachment device.

In an embodiment, the pool cleaning system can include an angled attachment device, the device structured to include mating holes for attachments configured at 90 degrees around a circumference of the device.

In another embodiment, the pool cleaning system can also include an angled attachment device, the device including another set of mating holes offset from the other mating holes arranged such that angled attachment device can engage with specialty tools at 45-degree increments around a circumference of the angled attachment device.

In yet another embodiment, the pool cleaning system can include an angled attachment device, the device including angles 85°, 75°, 60°, 30°, 20°, 15°, and 5 degrees from a centerline of a pool pole and/or any angle in between.

In an aspect, the pool cleaning system can include beveled and angled specialty tools, the specialty tools configured to allow pool cleaning to occur with nearly expended surface areas on portions of the specialty devices, thereby extending the working life of the specialty tools.

In another aspect, the pool cleaning system can also include various handles on a proximal and/or distal end of the pool pole.

In yet another aspect, the pool cleaning system can include angled attachment devices, the devices including materials such as, but not limited to, plastic, polyvinyl chloride, composites, ceramics, metals, and/or fiberglass.

In an aspect, the pool cleaning system can include specialty tools, the tools configured to connect with an angled attachment device at angles at 15, 30, and/or 45-degree increments from centerline of the attachment device in all axes.

In another aspect, the pool cleaning system can also include rotating and/or reciprocating brushes, the brushes powered by water pressure, air pressure, and/or electric power.

In yet another aspect, the pool cleaning system can include chemical feed systems.

In an embodiment, the pool cleaning system can include rubber coated grips.

In another embodiment, the pool cleaning system can also include handles, the handles configured to be offset from each other.

In yet another embodiment, the pool cleaning system can include straight and/or curved handles.

In an aspect, the pool cleaning system can include a reinforced section, the section including materials including, but not limited to, plastic, polyvinyl chloride, polymers, composites, ceramics, metals, and/or fiberglass. The reinforced section configured to provide adequate structural support to the angled attachment device for manual pool surface and pool surface area cleaning.

In another aspect, the pool cleaning system can also include a reinforced section, the section including materials with spring memory.

In yet another aspect, the pool cleaning system can also include a reinforced section on one, two, three, or four sides of an angled attachment device.

In an embodiment, the pool cleaning system can include a reinforced section on an angled attachment device on 10°, 45°, 90, 180, 270°, 360° and/or any degree in between around a circumference of the angled attachment device.

In another aspect, the pool cleaning system can also include cobweb brush cleaners, the cleaners configured to clean screens.

In yet another aspect, the pool cleaning system can include a pressure wash attachment.

In an aspect, the pool cleaning system can include specialty tools configured to clean gutters.

In another aspect, the pool cleaning system can also include stain removal tools.

In yet another aspect, the pool cleaning system can include pumice stones configured to connect to an angled attachment device at including angles 85°, 75°, 60°, 30°, 20°, 15°, and 5° and any angle in between from a centerline of the angled attachment device.

In an embodiment, the pool cleaning system can include an acid washing assembly.

In another embodiment, the pool cleaning system can include an angled attachment device configured to mate with standard pool pole attachment methods, including but not limited to, mating holes, pegs, spring loaded nubs, and/or clips.

In yet another embodiment, the pool cleaning system can also include specialty tools including, but not limited to, straight and/or round brushes, circular and/or oval skimmer nets, automatic and/or manual vacuum attachments, and/or electric powered stain removal systems.

In an aspect, the pool cleaning system can include a reinforced section on an angled attachment device, the section including shapes, but not limited to, rectangular, square, oval, circular, and/or trapezoidal.

In another aspect, the pool cleaning system can also include angled attachment devices, the devices including angles of 5°, 30°, 45°, 90°, 135°, 175° and/or any angle in between.

In yet another aspect, the pool cleaning system can include a chemical feed assembly, the chemical feed assembly configured to deploy chemical proportional to an area needing to be cleaned and because of the assembly's attachment to an angled attachment device, minimizes excessive delivery of chemical thereby increasing the life cycle of pool surfaces and pool area surfaces.

In an embodiment, the pool cleaning system can include adjustable mechanisms designed to configure an angled attachment device to include angles of 5°, 30°, 45°, 90°, 135°, 175° and/or any angle in between without the need to remove and/or change components.

In embodiments, the system can include reinforced sections being formed with the attachment device as a unitary piece.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, embodiments of the present invention are directed towards methods, systems, and apparatus of pool cleaning systems configured to allow pool cleaning professionals to effectively and efficiently clean pool surfaces and pool area surfaces while minimizing acute and/or chronic injuries to the pool cleaning personnel.

Figure 1:
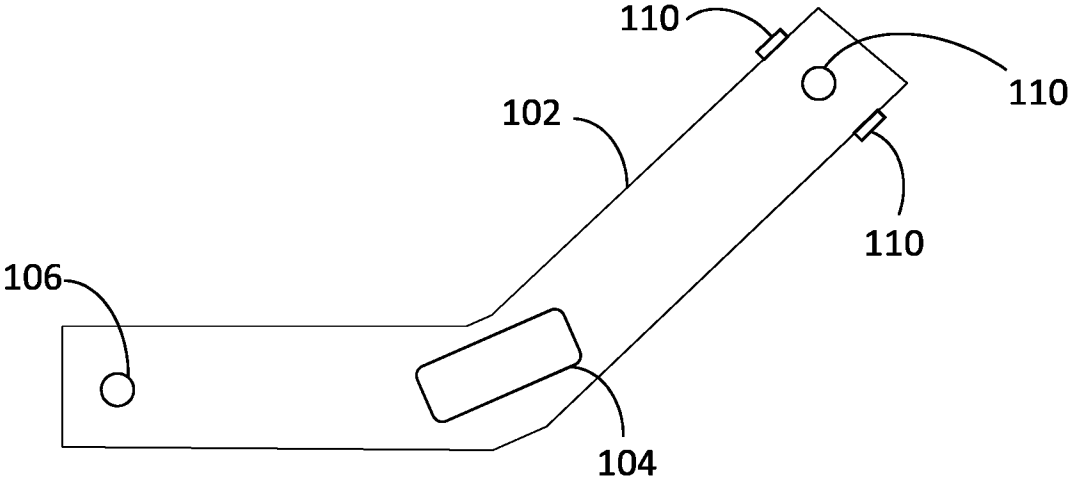
FIG. 1 presents a side view of an angled attachment device in an embodiment of the present invention.

FIG. 1 presents a side view of an embodiment of a pool cleaning system displaying an angled attachment device 102. The angled attachment device 102 can include a reinforced section 104. The reinforced section 104 arranged to provide structural support for pool cleaning evolutions. The reinforced section 104 can include, but is not limited to, circular, oval, rectangular, square, and/or trapezoidal shapes. Further, the reinforced section can include materials such as, but not limited to, plastics, PVC, polymers, ceramics, composites, wood, and/or metals. Additionally, the reinforced section 104 can include materials with spring memory. Additionally, the angled attachment device 102 can include mating holes 106. The mating holes 106 configured to connect with structures including, but not limited to pool poles 108, attachment devices, handles, and/or movement devices. The angled attachment device can also include pegs 110. The pegs configured to connect with specialty devices including, but not limited to, pumice stones, straight brushes, round brushes, rotating brushes, reciprocating brushes, chemical feed systems, nets, skimmers, vacuum attachments, and/or water pressure cleaners. In embodiments not shown, the holes and/or pegs can include a plurality of holes and/or pegs arranged around a circumference of the angled attachment device 102 along a length of the angled attachment device such that pool poles and/or specialty devices can connect at various degrees including 5°, 30°, 45°, 90°, 180°, 270°, 360° around the circumference of the angled attachment device and/or any angle in between.

Figure 2:
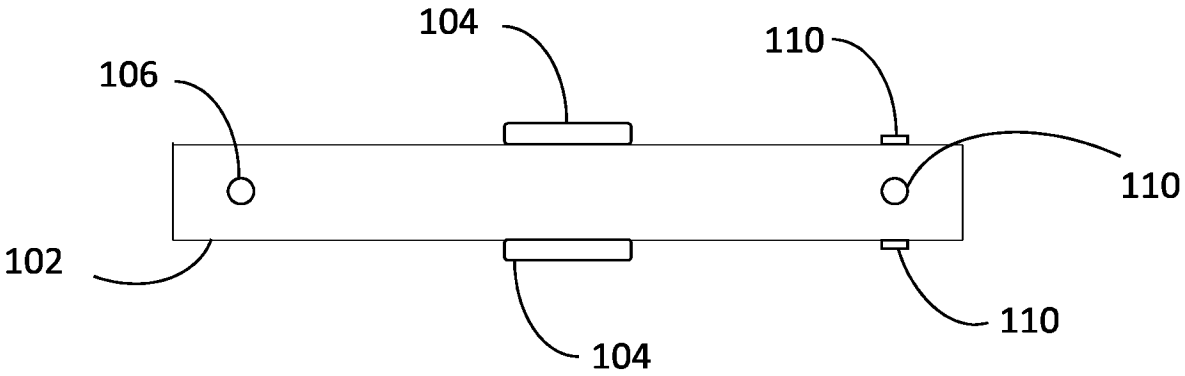
FIG. 2 presents a top view of an angled attachment device in an embodiment of the present invention.

Turning to FIG. 2, a top view of an angled attachment device 102 is illustrated. The angled attachment device can include materials such as, but not limited to, plastics, PVC, polymers, ceramics, composites, wood, fiberglass, and/or metals.

Figure 3:
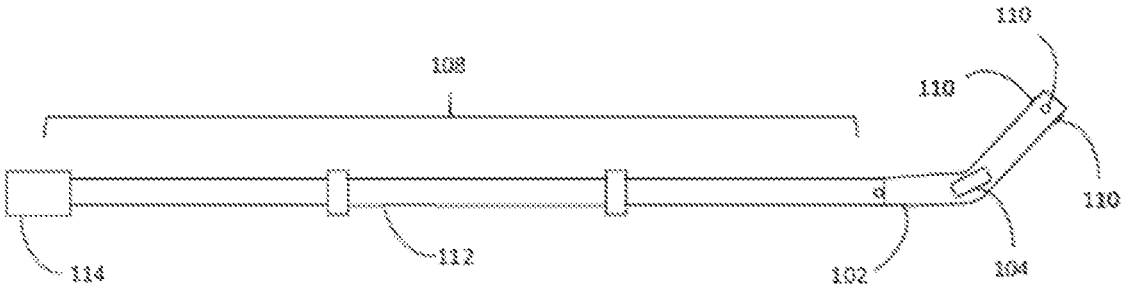
FIG. 3 presents a pool pole attached to an angled attachment device in an embodiment of the present invention.

As best seen in FIG. 3, a pool pole 108 is shown with an angled attachment device 102. A pool pole 108 can include a telescoping section 108 and a handle section 112 on a proximal end of the pool pole 108. In embodiments not shown, the angled attachment device 102 can include pegs, nobs, clips, spring loaded fasteners, posts, Snap-On connectors, holes, and/or other attachment devices. The attachment devices configured to provide engagement of the angled attachment device 102 to the pool pole 108 at a plurality of angles including but not limited to 5°, 30°, 45°, 60°, 90°, 180°, 270°, 360°, and/or any angle in between, around the circumference of the pool pole 106. The pool pole can include a handle 114.

Figure 4:
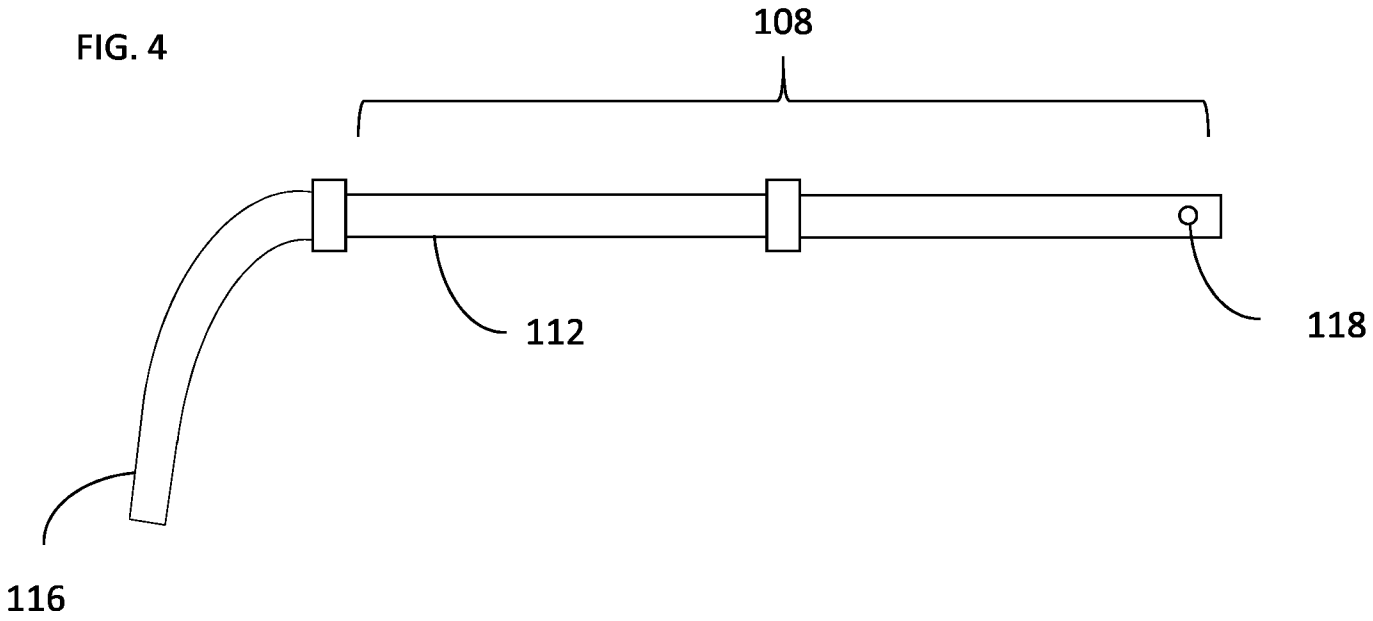
FIG. 4 presents a pool pole with a curved component in an embodiment of the present invention.

Referencing FIG. 4, an embodiment of a pool cleaning system is shown with an angled handle section 116. The angled handle section 116 arranged to provide pool cleaning personnel with an angle to clean pool surfaces and pool area surfaces while providing an ergonomic fashion to maneuver the pool pole 108 in order to minimize acute and/or chronic injury to the pool cleaning personnel. The pool pole 108 can include pegs 118, the pegs 118 arranged to attach to an angled attachment device 102.

Figure 5:
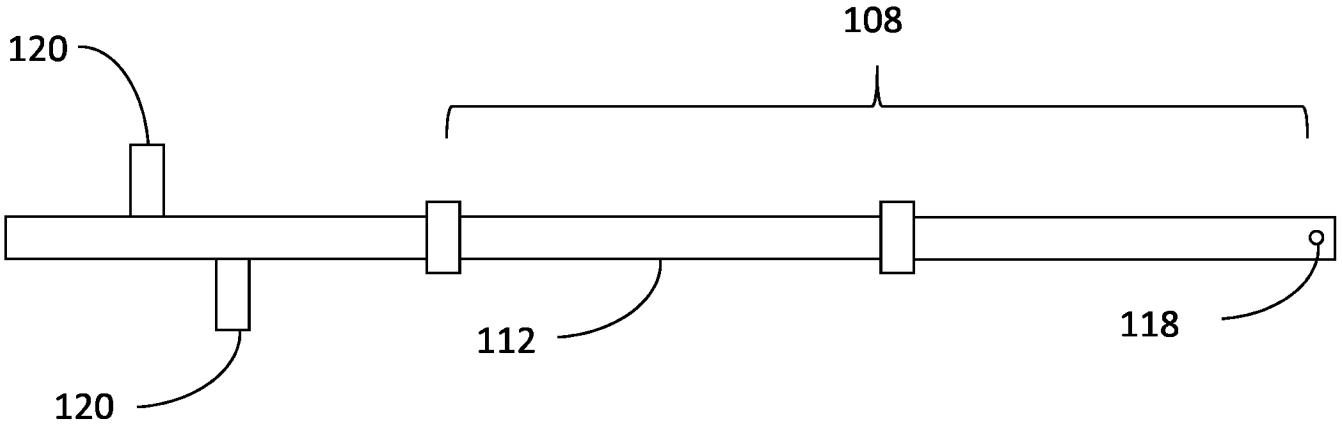
FIG. 5 presents a pool pole with handles in an embodiment of the present invention.
Figure 6:
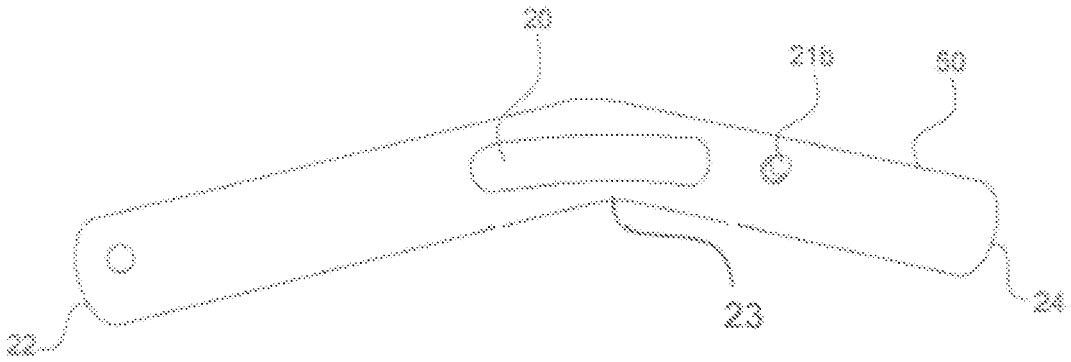
FIG. 6 depicts a perspective view of another pool handle attachment according to the present invention.

As seen in FIG. 5, an embodiment of a pool cleaning system is shown with a pool pole 108 including handle bars 120 attached to the pool pole 108. In embodiments not shown, the handle bars 120 can include straight, bent, curved, and/or shapes designed to allow pool cleaning personnel to maneuver the pool pole 108 in an ergonomic fashion. Further, the handle bars can include materials such as, but not limited to rubber, plastic, ceramic, wood, PVC, polymers, fiberglass, and/or metal. FIG. 6 depicts a perspective view of a pool handle attachment tool 50 according to the present invention. The pool handle attachment 50 of FIG. 6 includes a first opening 22 and a second opening 24. At the midpoint of the tool attachment is a bend 23 creating an angle of the attachment tool. Further at the bend 23 is a reinforced section 20. The reinforced section 20 provides a strengthening of the bend 23 to prevent breakage of the tool during use. An insert 21*b* is provided to lock the pool attachment 50 into an existing pool handle. Further holes are provided near the opening 22 around the perimeter of the pool attachment tool 50.

The pool attachment tool 50 is substantially cylindrical and includes an angle for application during use. The side view shown in FIG. 6 shows a protruding peg 21*b* that is part of the attachment clip assembly within the pool attachment tool 50.

Figure 7:
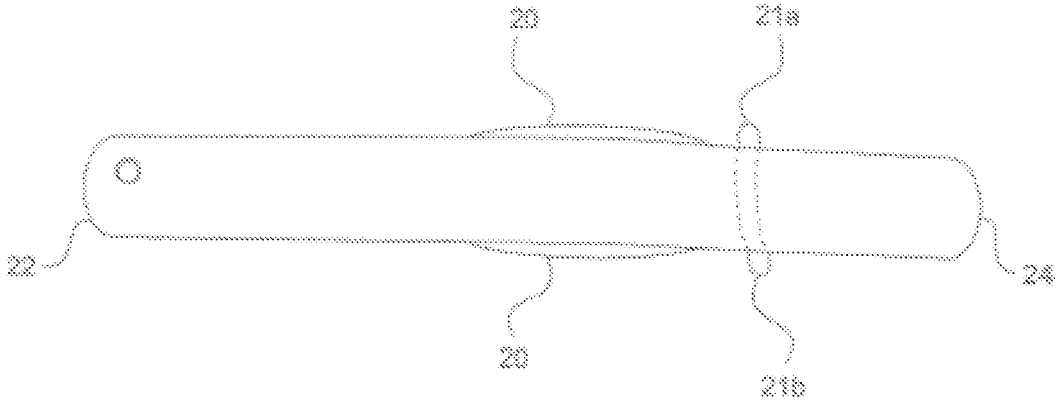
FIG. 7 depicts a reverse view of another pool handle attachment according to the present invention.

FIG. 7 shows a rotated view of the pool attachment tool with a bend 23 shown and a reinforcement section 20 on each side thereof. The view of FIG. 7 also shows peg 21*a* opposite to peg 21*b* where each peg collapses and expands within the attachment tool 50 in order to engage the tool 50 onto an existing pool handle.

Figure 8:
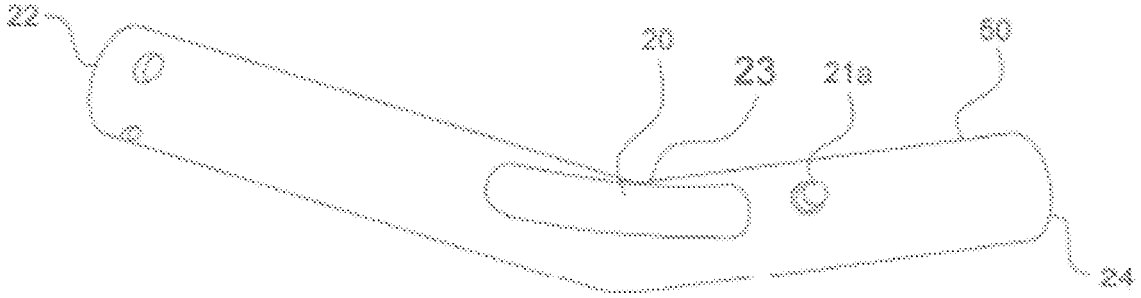
FIG. 8 depicts a second perspective view of another pool handle attachment according to present invention.

A opposing and reverse view of FIG. 6 is shown in FIG. 8 showing the opposing side of the attachment tool 50. Here the bend is at the bottom of the view with a reinforcement section 20 shown and the protruding peg 21*a*.

Figure 9:
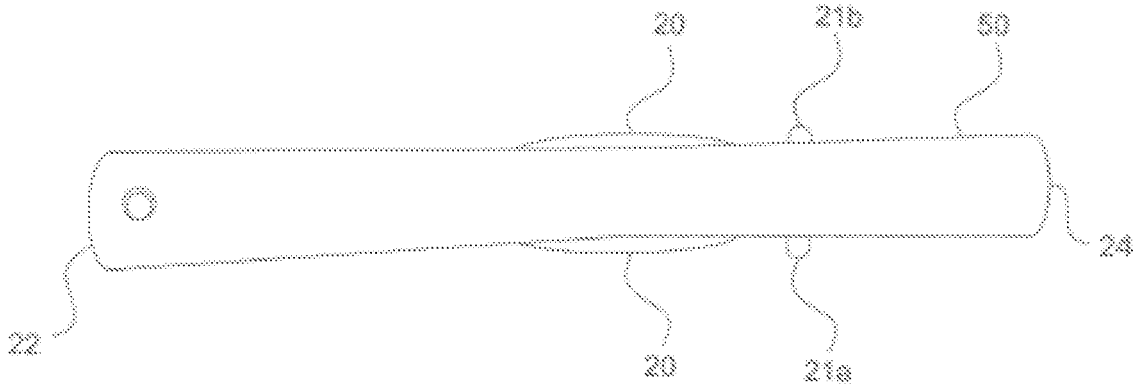
FIG. 9 depicts an inside view of another pool handle attachment according to the present invention.

Finally, FIG. 9 shows another view rotating the tool 50 90 degrees on the opposite side of the attachment tool 50 and the angle side of the attachment tool 50 is shown.

In embodiments not shown, the pool cleaning system can include specialty devices, the specialty devices arranged to allow pool cleaning personnel to clean and restore pool surface and pool area surface areas. The specialty devices can include externally powered devices to rotate, reciprocate, and/or to move brushes, acid cleaning mechanisms, skimmers, burnishing items, nets, and/or pumice stones. The specialty devices can be configured to attach to an end of the angled attachment device.

While the foregoing written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A pool cleaning system comprising:

a pool pole;

an angled attachment device configured to connect to an end of the pool pole, wherein the angled attachment device includes two linear members and a curved section defined by an angle between the two members; and a plurality of specialty tools structured to connect to an end of the angled attachment device, wherein the angled attachment device is angled substantially about 45 degrees and wherein the angled attachment device includes a reinforced section on the angled attachment device positioned about a middle of the angled attachment device and another reinforced section on an opposing side of the angled attachment device positioned about the middle of the angled attachment device, and wherein the reinforced sections include a substantially straight and thickened region extending onto portions of the linear members, and wherein a body of the angled attachment device and the reinforced sections are a formed together unitary piece.

2. The system as recited in claim 1 wherein the pool pole further comprises a curved component.

3. The system as recited in claim 1 wherein the pool pole further comprises handles.

4. The system as recited in claim 1 wherein the angled attachment device includes mating holes, the mating holes configured to a respective one of the specialty tools at a plurality of angles.

5. The system as recited in claim 1 wherein the pool pole further comprises curved components attached to a proximal and/or distal end of the pool pole.

* * * * *